US011586147B2

(12) United States Patent
Feyer et al.

(10) Patent No.: US 11,586,147 B2
(45) Date of Patent: Feb. 21, 2023

(54) HOROLOGICAL CARRIAGE-STOP MECHANISM WITH STOP WHEEL

(71) Applicant: Omega SA, Biel/Bienne (CH)

(72) Inventors: Julien Feyer, Vernier (CH); Timothee Jeanrenaud, Yverdon-les-Bains (CH)

(73) Assignee: Omega SA, Biel/Bienne (CH)

( * ) Notice: Subject to any disclaimer, the term of this patent is extended or adjusted under 35 U.S.C. 154(b) by 331 days.

(21) Appl. No.: 16/899,115

(22) Filed: Jun. 11, 2020

(65) Prior Publication Data

US 2021/0026300 A1 Jan. 28, 2021

(30) Foreign Application Priority Data

Jul. 23, 2019 (EP) ..... 19187807

(51) Int. Cl.
*G04B 17/28* (2006.01)
*G04B 27/00* (2006.01)

(52) U.S. Cl.
CPC ..... *G04B 17/285* (2013.01); *G04B 27/004* (2013.01)

(58) Field of Classification Search
CPC ..... G04B 17/285; G04B 27/004
See application file for complete search history.

(56) References Cited

U.S. PATENT DOCUMENTS 7,244,062 B2 * 7/2007 Golay ..... G04B 27/004 368/142
7,350,967 B2 4/2008 Jujo
9,354,608 B2 5/2016 Donze et al.
2004/0062149 A1 4/2004 Geyer
2017/0060090 A1 3/2017 Heise

FOREIGN PATENT DOCUMENTS

CN 1270331 A 10/2000
CN 1324457 A 11/2001
CN 1950759 A 4/2007
CN 101268425 A 9/2008
(Continued)

OTHER PUBLICATIONS

Combined Taiwanese Office Action and Search Report dated Dec. 30, 2020 in Taiwanese Patent Application No. 109120212, (submitting English translation only), 7 pages.
(Continued)

*Primary Examiner* — Edwin A. Leon
*Assistant Examiner* — Jason M Collins
(74) *Attorney, Agent, or Firm* — Obion, McClelland, Maier & Neustadt, L.L.P.

(57) ABSTRACT

A regulating device including an oscillator and capable of blocking this oscillator carried by the carriage of a tourbillon or karussel, and including a stop wheel, coaxial to the carriage wheel and limited in angular mobility by a stop pin limited by a slot of the carriage, and including a toothing engaging with an external control member for the rotation thereof, the carriage carries a resilient element arranged so as to bear against a wheel set of the oscillator to stop the latter when the control member is in an active position, and to remain remote from the carriage and from any wheel set of the oscillator when the control member is in a rest position, wherein the stop wheel is in another angular position relative to the carriage wheel.

11 Claims, 6 Drawing Sheets

(56) References Cited

FOREIGN PATENT DOCUMENTS

| | | | |
|---|---|---|---|
| CN | 201402376 | Y | 2/2010 |
| CN | 103092051 | A | 5/2013 |
| CN | 106896699 | A | 6/2017 |
| EP | 1 451 647 | A2 | 9/2004 |
| EP | 1 451 647 | B1 | 1/2008 |
| EP | 1 528 443 | B1 | 8/2008 |
| EP | 2 397 920 | A1 | 12/2011 |
| EP | 3 136 186 | A1 | 3/2017 |
| EP | 3 193 216 | A1 | 7/2017 |
| JP | 2004-286744 | A | 10/2004 |
| WO | WO 03/048871 | A2 | 6/2003 |

OTHER PUBLICATIONS

European Search Report dated Jan. 10, 2020 in European Application 191878073 filed Jul. 23, 2019 (with English Translation of Categories of cited documents), 3 pages.

Combined Chinese Office Action and Search Report dated Jun. 3, 2021 in Patent Application No. 202010716935.5 (with English translation of Category of Cited Documents), 7 pages.

* cited by examiner

HOROLOGICAL CARRIAGE-STOP MECHANISM WITH STOP WHEEL

FIELD OF THE INVENTION

The invention relates to a horological regulating device for a watch, comprising an oscillator, and means for limiting the variation of rate of said oscillator, in the different positions of said watch in space, said device comprising at least one tourbillon or a karussel, comprising said oscillator, and which comprises a carriage which is mounted such that it pivots about a carriage axis relative to a plate, which carries a fixed wheel when said regulating device comprises a tourbillon, which carriage carries said oscillator and comprises a carriage pinion or a carriage wheel arranged so as to be driven by an energy source of the watch or of a movement by way of a gear train, and which carriage carries an escapement mechanism arranged so as to engage with said oscillator, and comprising an escape pinion meshing with said fixed wheel when said regulating device comprises a tourbillon or meshing with a wheel of the gear train, when said regulating device comprises a karussel.

The invention further relates to a watch comprising a horological movement comprising energy storage and/or distribution means, an oscillator, hand-setting means, and such a regulating device incorporating this oscillator.

The invention relates to the field of mechanical watches with high chronometric precision equipped with tourbillons or karussels, and so-called second-stop or carriage-stop mechanisms arranged so as to finely adjust the state of the watch.

BACKGROUND OF THE INVENTION

British patent No. 674764 filed by HEPTINSTALL discloses a spring-finger for blocking a balance.

European patent No. 1617305B1 filed by MONTRES BREGUET discloses a control for manually stopping, via the stem, pad levers for blocking a balance.

European patent No. 2787400B1 filed by CHOPARD discloses a stop element, integral with a carriage such that it rotates therewith, and which is a disc coaxial to this carriage, axially displaced for axial friction with a balance.

European patent No. 2085832B1 filed by FREDERIC PIGUET discloses a friction clutch mechanism, by radially placing clutching elements at the ends of star-shaped arms in a cylindrical surface of a driving plate, under the axial effect of a clutch spring.

European patent EP3136186 filed by GLASHUETTE UHRENBETRIEB relates to a clockwork with a tourbillon unit, comprising, a base plate, a mobile cage connected to a secondary drive and rotatably mounted on the base plate, a balance wheel mounted on mobile cage, and an escape wheel mounted on the mobile cage and in operative connection with the balance, and a balance stop device which can be brought into engagement with the balance. It also includes an adjusting device controlled by an external actuator for the arbitrary angular orientation of the mobile cage.

SUMMARY OF THE INVENTION

The invention proposes stopping a tourbillon or karussel carriage when setting the hands so as to adjust a watch to the nearest second.

For this purpose, the invention relates to a horological regulating device for a watch, arranged to limit the variation of rate of an oscillator comprised in this regulating device, according to claim 1.

The invention further relates to a watch comprising a horological movement comprising energy storage and/or distribution means, an oscillator, hand-setting means, and such a regulating device.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 1:
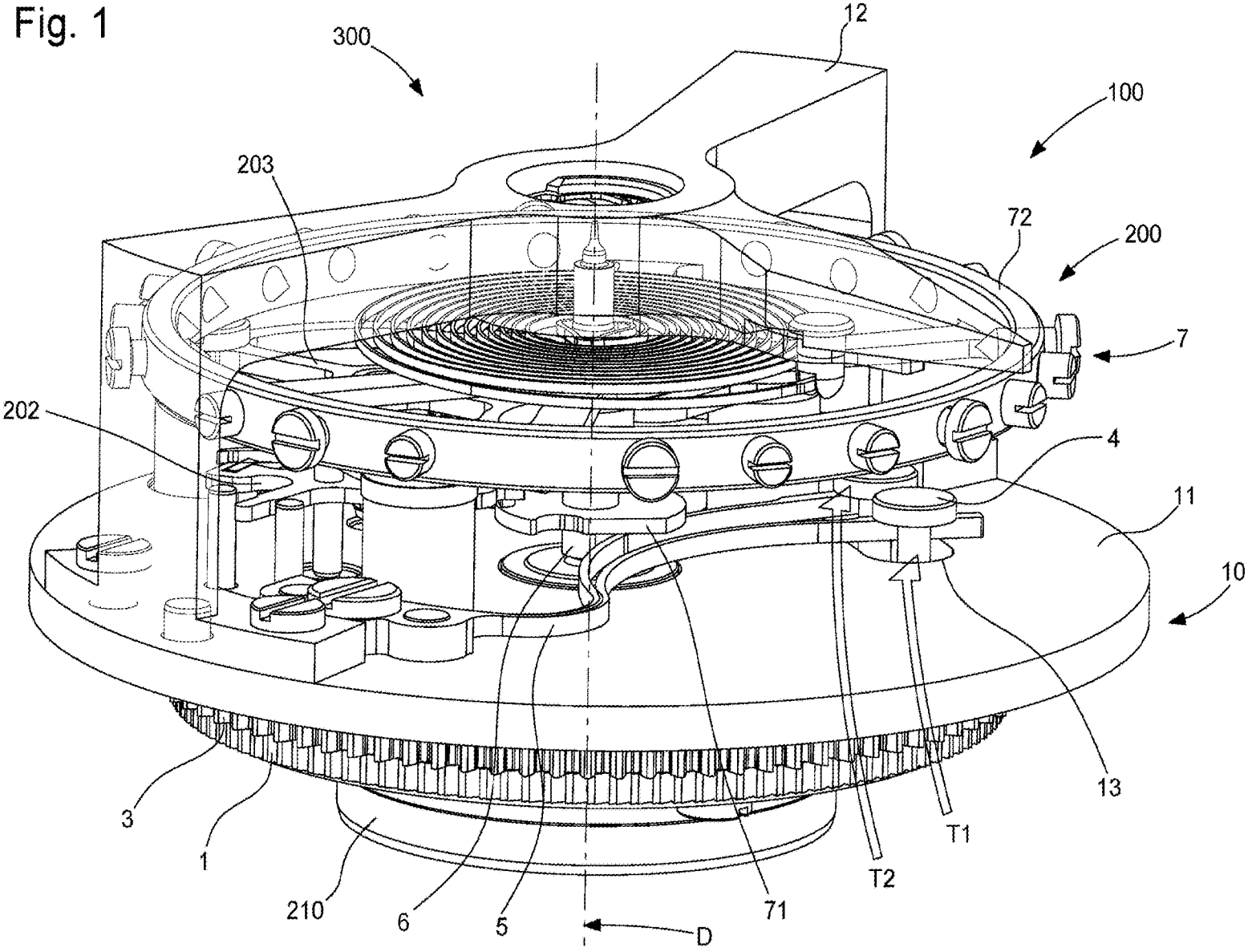
FIG. 1 diagrammatically shows a partial, perspective view of a horological regulating device for a watch, for limiting the variation of rate of an oscillator comprised in this regulating device, this sprung balance oscillator being carried by the carriage of a tourbillon, which further carries, on either side of a lower carriage bridge, a stop wheel coaxial to the carriage wheel, and a stop mechanism partially carried by this stop wheel and by the lower carriage bridge, this stop mechanism comprising a resilient stop element, in this case a stop spring, which is arranged such that it bears against a cam shown beneath the double roller of the balance, under the effect of a stop pin moved by a relative angular movement between the stop wheel and the carriage wheel; this figure further shows, in the bottom part, a fixed wheel arranged such that it is fastened to a plate of a movement, and which is travelled externally by an escape pinion, for the movement of the carriage.
Figure 2:
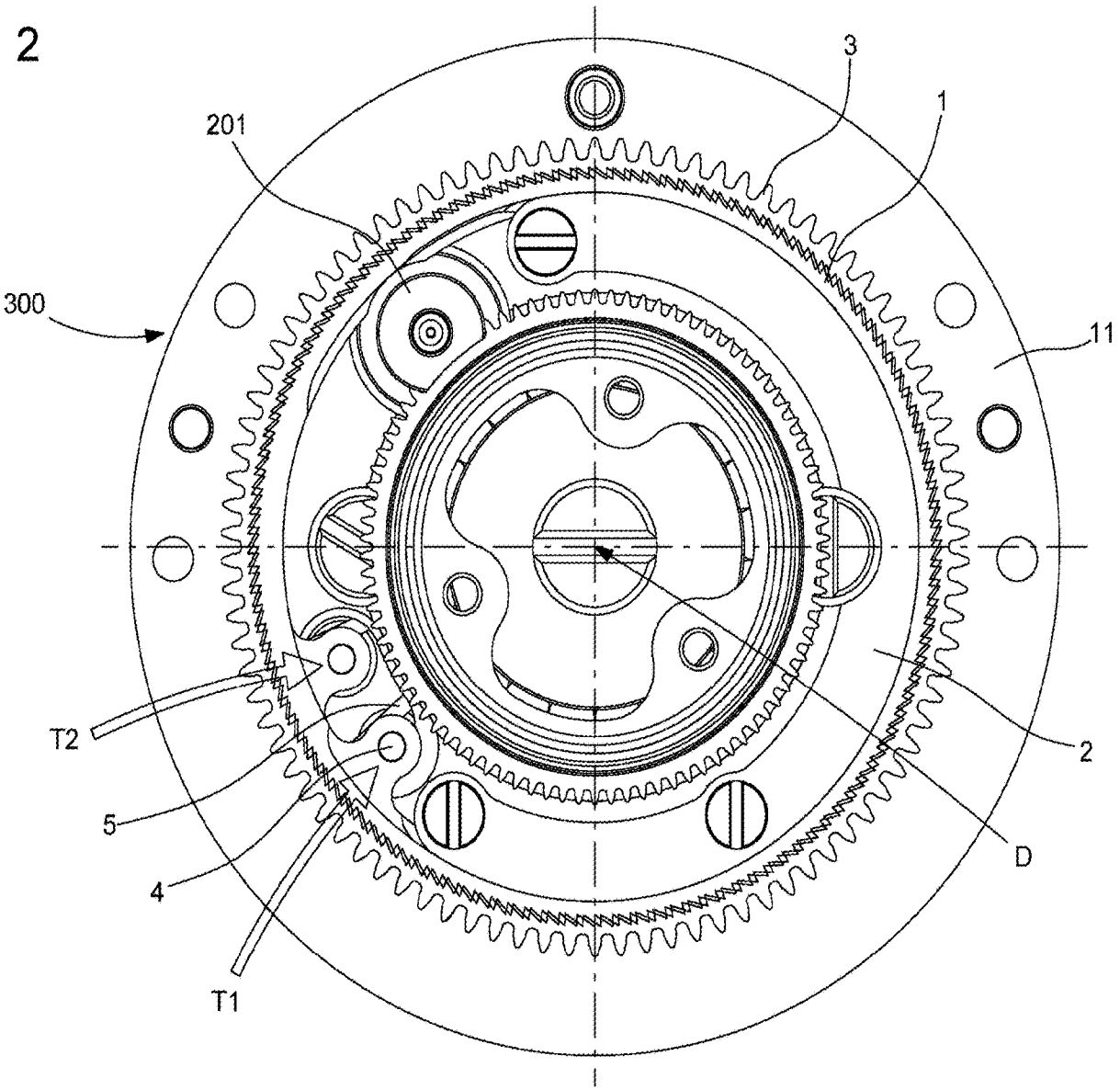
FIG. 2 shows a bottom view of the mechanism in FIG. 1, showing, from the exterior to the interior, the lower carriage bridge, the carriage wheel, the stop wheel which comprises an inclined toothing and which carries the stop pin, and which is shown to be superimposed in the two end positions thereof, the escape pinion which meshes with the fixed wheel, and the ball bearing guiding the carriage; the positionings corresponding to positions T1 and T2 of the rod are shown superimposed.

The invention relates to the field of mechanical watches with high chronometric performance levels.

Known methods of improving insensitivity to the positions of a watch 1000 involve equipping it with a horological regulating device 100, comprising an oscillator 200, and comprising means for limiting the variation of rate of this oscillator 200, in the different positions of the watch 1000 in space.

This device 100 comprises at least one tourbillon 300 or a karussel which, in either case, comprises a carriage 10 which is mounted such that it pivots about a carriage axis D relative to a plate 900.

This plate 900 carries a fixed wheel 210 when the regulating device 100 comprises a tourbillon 300.

The carriage 10 carries the oscillator 200, and comprises a carriage wheel 3, which is arranged so as to be driven by an energy source 400 of the watch 1000 or of a movement 800 comprised in the watch, by way of a gear train. This energy source 400 can in particular comprise at least one barrel or similar element. It goes without saying that the carriage wheel can be replaced by a carriage pinion; the carriage wheel, or the carriage pinion, can be integral with a lower carriage bridge or can form a single-piece component therewith. Other arrangements are possible for fastening the carriage pinion or wheel to the carriage 10.

The carriage 10 further carries an escapement mechanism 700, which is arranged so as to engage with the oscillator 200, and which comprises an escape pinion 201. In the non-limiting alternative embodiment shown, the carriage 10 comprises a lower bridge 11 and an upper bridge 12. The upper carriage bridge 12 is positioned above and protects the oscillator 200, the escapement mechanism 700, and a part of the stop mechanism according to the invention, and can advantageously comprise a display index.

This escape pinion 201 meshes with the fixed wheel 210 when the regulating device 100 comprises a tourbillon, or meshes with a wheel of the gear train, for example a third wheel or a fourth wheel, when the regulating device 100 comprises a karussel.

The stop mechanism according to the invention allows an oscillator wheel set to be stopped, in particular an inertia wheel set such as a balance, carried by a tourbillon or karussel carriage, during the hand-setting operation. The mechanism is designed to also stop the carriage.

According to the invention, to block the oscillator 200, the device 100 comprises stopping means with a stop wheel 1, which is coaxial to the carriage wheel 3. The angular mobility of the stop wheel 1 relative to the carriage wheel 3 is limited by a stop pin 4, which is carried by the stop wheel 1, and the axial motion whereof is limited by a slot 13 comprised in the carriage 10, and which in particular comprises a lower carriage bridge 11, comprised in the carriage 10. The carriage wheel 3 further comprises an opening for allowing the stop pin 4 to pass.

This stop wheel 1 comprises a toothing, which is arranged such that it engages with a control member external to the tourbillon 300 or karussel for rotating the stop wheel 1 under the effect of a movement exerted by this control member. This control member can in particular comprise a setting stem or similar element.

Moreover, the carriage 10 carries, in particular but not in a limiting manner at a lower carriage bridge 11 in the non-limiting case shown in the figures, a resilient element 5, which is arranged so as to bear against a wheel set of the oscillator 200 to stop the latter when the control member is in an active position wherein the stop wheel 1 is in a first angular position relative to the carriage wheel 3, and so as to remain remote from any wheel set of the oscillator 200 when the control member is in a rest position, wherein the stop wheel 1 is in a second angular position relative to the carriage wheel 3. It is understood that any passage from the rest position to the active position triggers the immediate stopping of the oscillator.

More particularly, this resilient element 5 is or comprises a spring, and in particular comprises at least one resilient strip.

More particularly, the wheel set of the oscillator 200, against which the resilient element 5 bears, is synchronous with the inertial element of the oscillator.

Thus, relative to a conventional tourbillon or karussel, which comprises a carriage 10, which itself carries an oscillator 200, in particular but not limited to a sprung balance 7 as shown in the figures, the mechanism according to the invention comprises a limited number of specific components, mounted on the carriage 10:

- a stop wheel 1;
- a stop wheel bridge 2;
- a stop pin 4 carried by the stop wheel 1, which is limited in mobility relative to a slot 13 made in the carriage 10 or the lower carriage bridge 11;
- a resilient element 5, in particular a stop spring, fastened to the carriage 10, and more particularly to a lower carriage bridge 11;
- a stop cam 6 mechanically synchronous with the inertial mass of the oscillator 200.

More particularly, the wheel set of the oscillator 200, against which the resilient element 5 bears, is a stop cam 6, which is synchronous with an inertial mass 72 comprised in the oscillator 200, and which is arranged so as to stop the angular indexing of the inertial mass 72 in a position that differs from the dead centre of the oscillator 200, so as to ease the restarting of the oscillator 200 when the stop wheel 1 is subsequently released.

More particularly, the stop cam 6 is coaxial with the inertial mass 72, and is arranged such that it pivots about the carriage axis D.

More particularly, the oscillator 200 is a sprung balance assembly 7, a balance 72 whereof constitutes an inertial mass.

Even more particularly, this balance 72, the balance double roller 71, and the stop cam 6 constitute a one-piece unit.

The figures show a stop cam 6 with a very simple profile, with a radial protrusion forming a single point, the purpose being to move away from the dead centre. In combination with the profile of the stop cam 6, the resilient element 5, in particular a stop spring, can also locally comprise a protrusion, or a bulge, to engage with the protrusion of the stop cam 6 and cause the stop cam 6 to be blocked in a position that differs from the dead centre of the oscillator 200.

More particularly, the resilient element 5 is arranged so as to bring the stop wheel 1 back into a rest position relative to the carriage wheel 3, in the absence of traction on the stop wheel 1.

More particularly, the stop wheel 1 comprises a pointed and inclined toothing, of the wolf tooth or triangular ratchet-wheel tooth type, or of a similar type, to allow same to engage by hooking with the control member, regardless of the angular position of the stop wheel 1.

More particularly, the resilient element 5 is a spring fastened to the carriage 10 or to a lower bridge 11 of the carriage 10, which lower bridge 11 comprises the slot 13 for limiting the relative angular travel between the stop wheel 1 and the carriage wheel 3, the ends of the slot 13 forming abutment positions of the stop pin 4 which define the first angular position and the second angular position of the stop wheel 1 relative to the carriage wheel 3.

More particularly, and as shown in the specific, non-limiting case of the figures, the escapement mechanism 700 is a coaxial escapement mechanism, and the escape pinion which causes the carriage 10 to move is an intermediate escape pinion 201.

The invention further relates to a watch 1000 comprising a horological movement 800 comprising energy storage means 400, hand-setting means 500, and such a regulating device 100 comprising at least one oscillator 200.

More particularly, the tourbillon 300 or karussel constitutes a display member of the watch 1000, in particular by way of a display index comprised in the upper bridge 12 or another element of the carriage 10, or is arranged so as to drive at least one display member of the watch 1000, and the hand-setting means 500 constitute or control the control member.

In an alternative embodiment, the regulating device 100 comprises a tourbillon 300, and the escape pinion 201 meshes with the fixed wheel 210 comprised in the plate 900.

In another alternative embodiment, the regulating device 100 comprises a karussel, the movement 800 comprises a gear train, in particular with a third wheel and a fourth wheel, and the escape pinion 201 meshes with a wheel set of the gear train, in particular but in a non-limiting manner, with the third wheel or the fourth wheel of the gear train.

Figure 3:
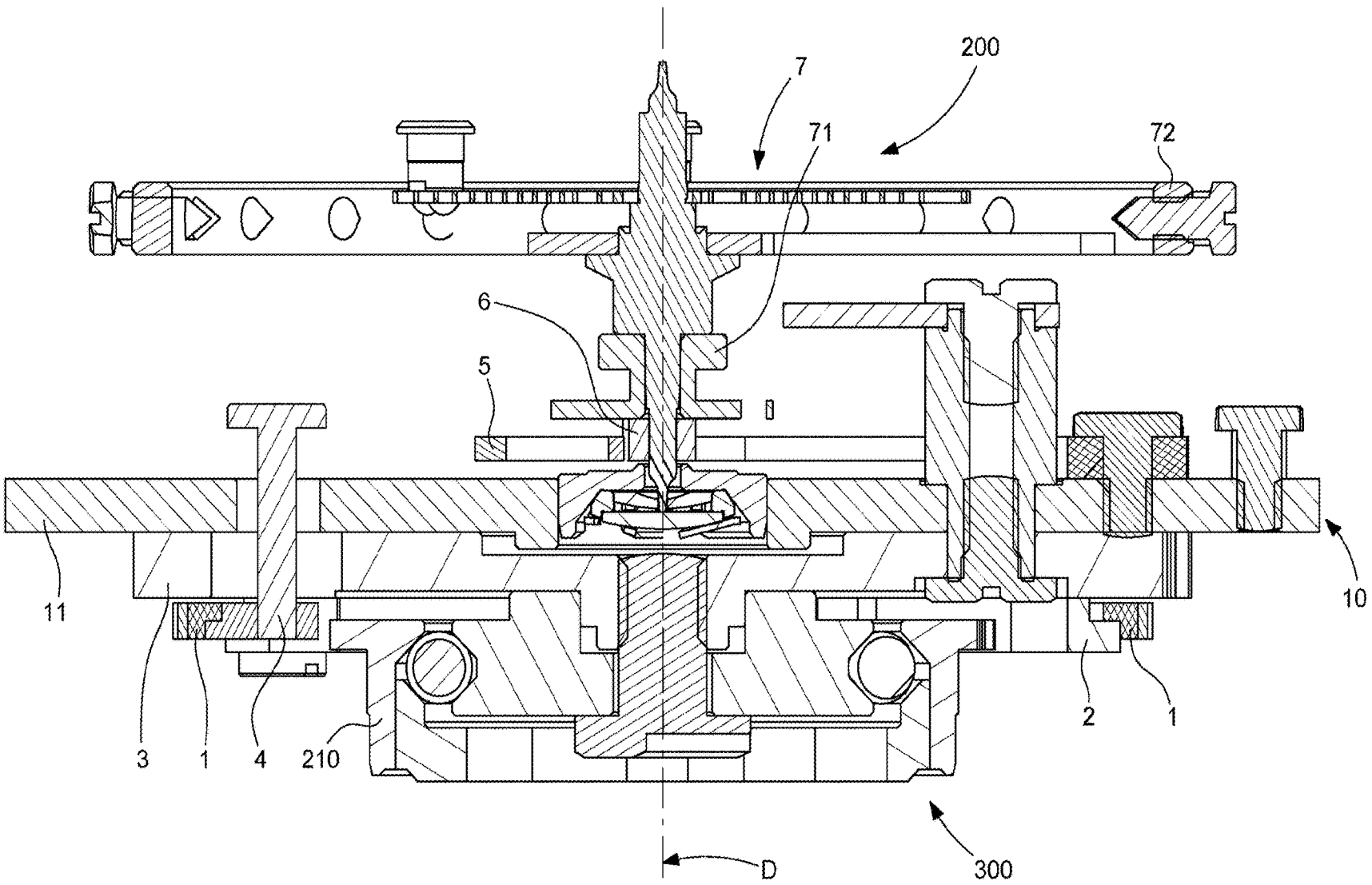
FIG. 3 diagrammatically shows a sectional view along the carriage axis of the mechanism in FIG. 1; on the left of this figure, the stop pin is capable of moving in a slot in the lower carriage bridge and engages, in a plane situated above the lower carriage bridge, with the resilient element formed by a spring which is arranged so as to press the stop cam shown between the lower carriage bridge and the double roller of the balance.
Figure 9:
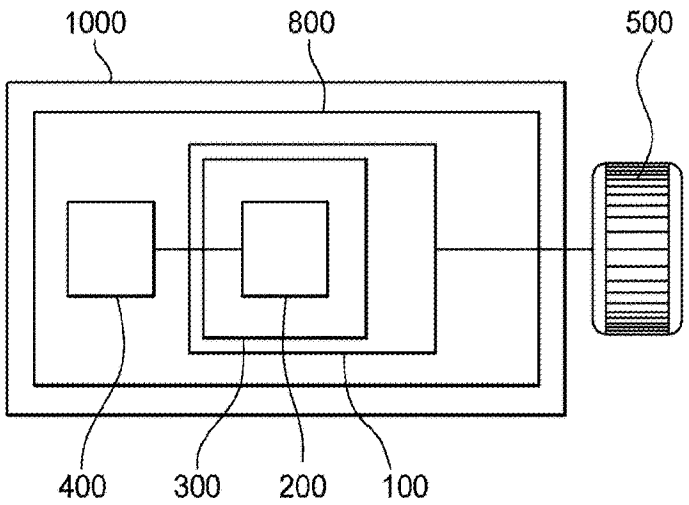
FIG. 9 is a block diagram showing a watch comprising a horological movement comprising energy storage means, an oscillator, hand-setting means, and such a regulating device.
Figure 4A:
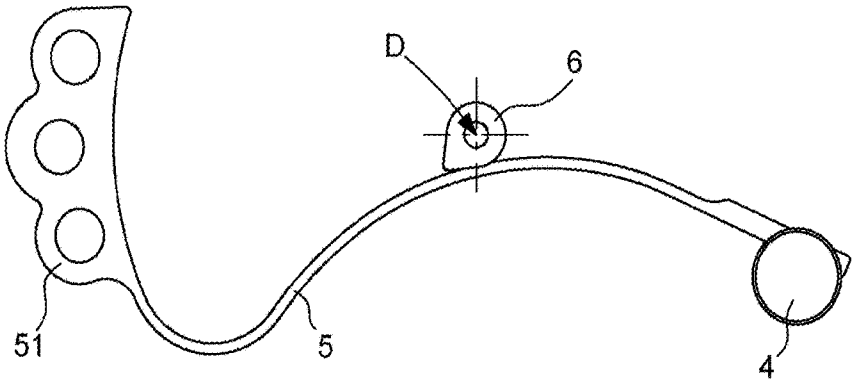
FIGS. 4A and 4B diagrammatically show an overhead view of an alternative embodiment wherein the stop spring comprises a protrusion arranged so as to engage with the protrusion of the stop cam in order to move away from the dead centre of the balance.
Figure 4B:
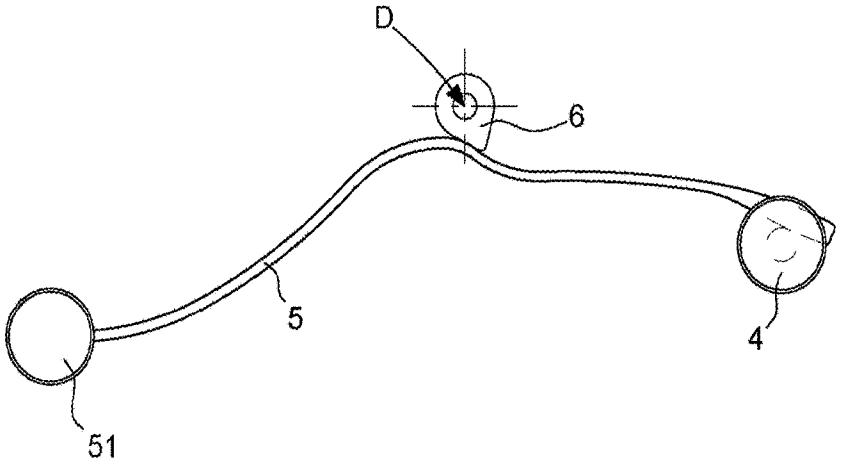

In normal operation, the tourbillon, or respectively the karussel, is driven by the gear train of the calibre and rotates on a ball bearing as shown in FIG. 3, or between two movement-blanks.

The operation of the invention is more particularly described for the passage from a rest position T1, wherein the oscillator is free, into a position T2, wherein the oscillator is blocked. This control member can thus be a conventional control rod for setting the hands. The stop wheel 1 is seen to comprise teeth that are cut and oriented such that they can interact with a control member, which is a mechanism external to the tourbillon, or respectively to the karussel, during the passage from T1 to T2. Such an external mechanism can be seen in the European patent document No. 2085832A1 filed by FREDERIC PIGUET SA.

To summarise, the shape of the teeth over the circumference of the stop wheel 1 is such that it allows the external mechanism to become hooked inside one of the teeth, regardless of the position of the stop wheel 1, and to cause same to pivot by a certain angle. This stop wheel 1 is positioned such that it rotates by the stop wheel bridge 2, and creates the play between the stop wheel bridge 2 and the carriage wheel 3. The stop wheel 1 carries the stop pin 4.

The stop pin 4 is in contact with the resilient element 5, in particular a stop spring, which is fastened to the carriage 10, and which has two purposes:

- in T1, bringing and holding the rotating stop wheel 1 in place;
- in T2, stopping the wheel set of the oscillator 200, and in particular the balance 72 of the sprung balance 7 in the case shown in the figures, in a preferred position, using the stop cam 6, which is integral with this wheel set.

When passing from T1 to T2, i.e. when passing into the hand setting position, the external mechanism comprising the control member becomes hooked in a tooth of the stop wheel 1 and causes same to pivot by a certain angle. The resilient element 5, in particular the stop spring, which holds the stop wheel 1 in place by way of the stop pin 4, is thus moved into the trajectory of the stop cam 6. Once contact has been made between the resilient element 5 and the stop cam 6, the oscillator 200, in particular the sprung balance 7, is stopped and can thus only be located in a preferred position for subsequent restarting when the system is released, since the oscillator 200 has been stopped in a position that is remote from the dead centre thereof, and the torque is sufficient to ensure restarting.

Figure 6:
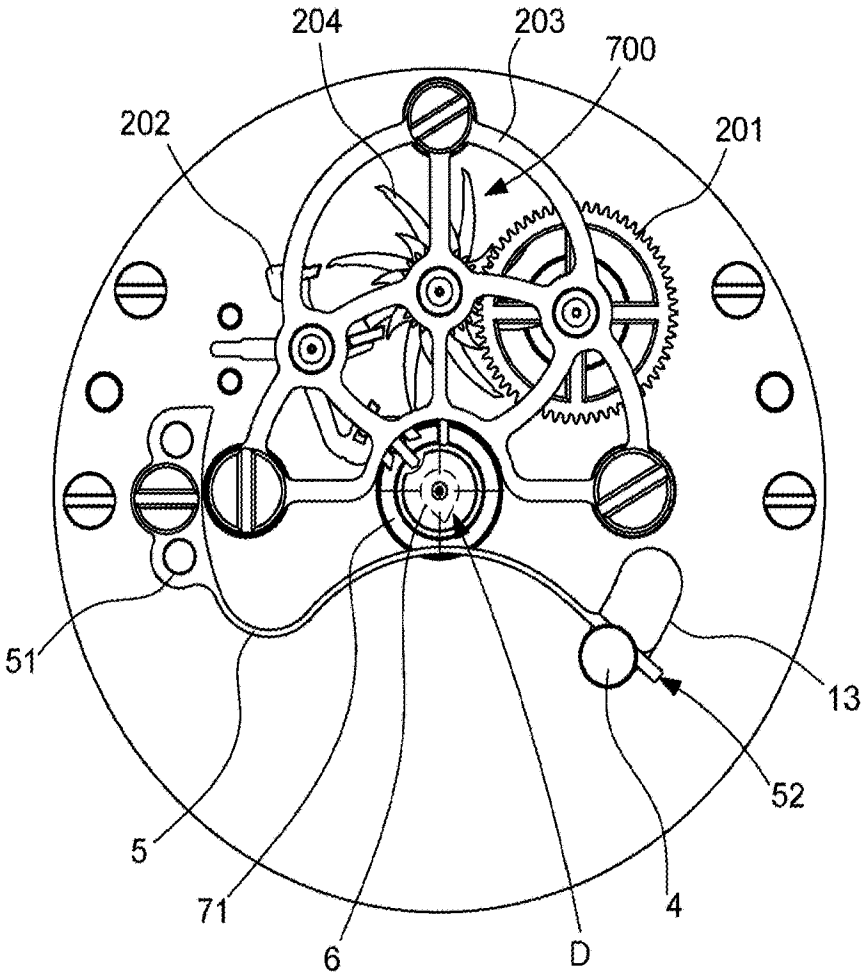
FIGS. 5 and 6 are partial, bottom and overhead views of the mechanism in FIG. 1, wherein the sprung balance is not shown, with the exception of the stop cam which is integral with the balance, in a rest position T1 wherein the oscillator is free to move.
Figure 5:
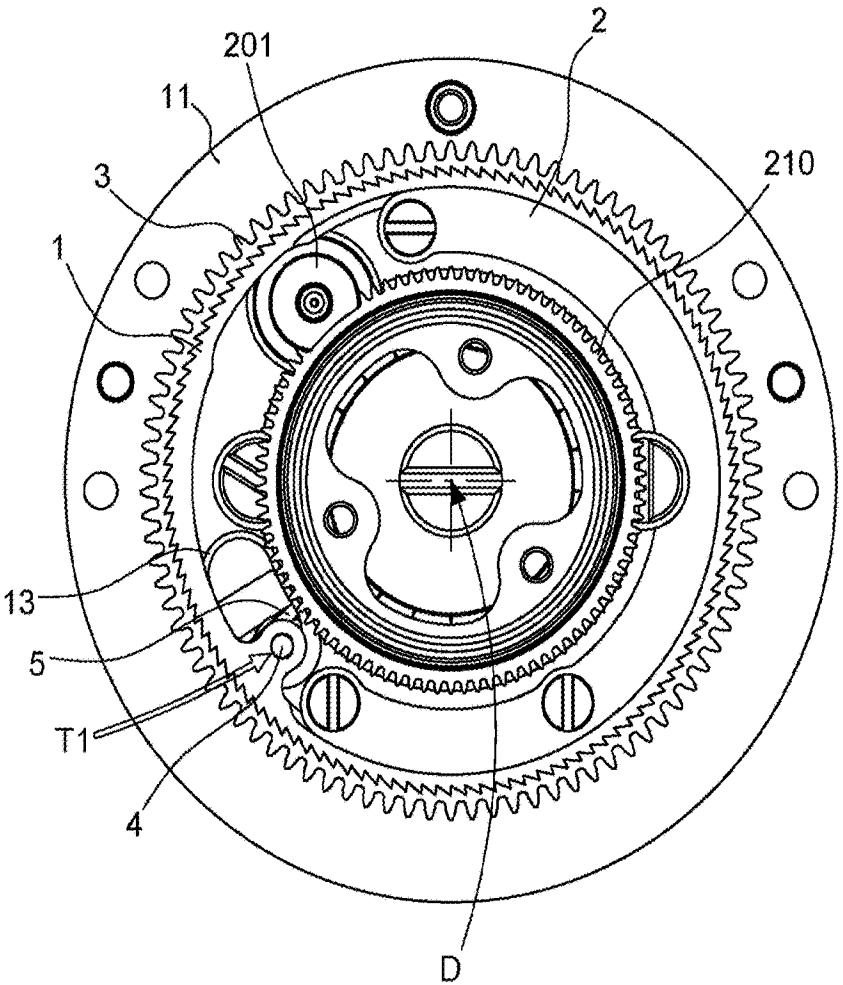
Figure 8:
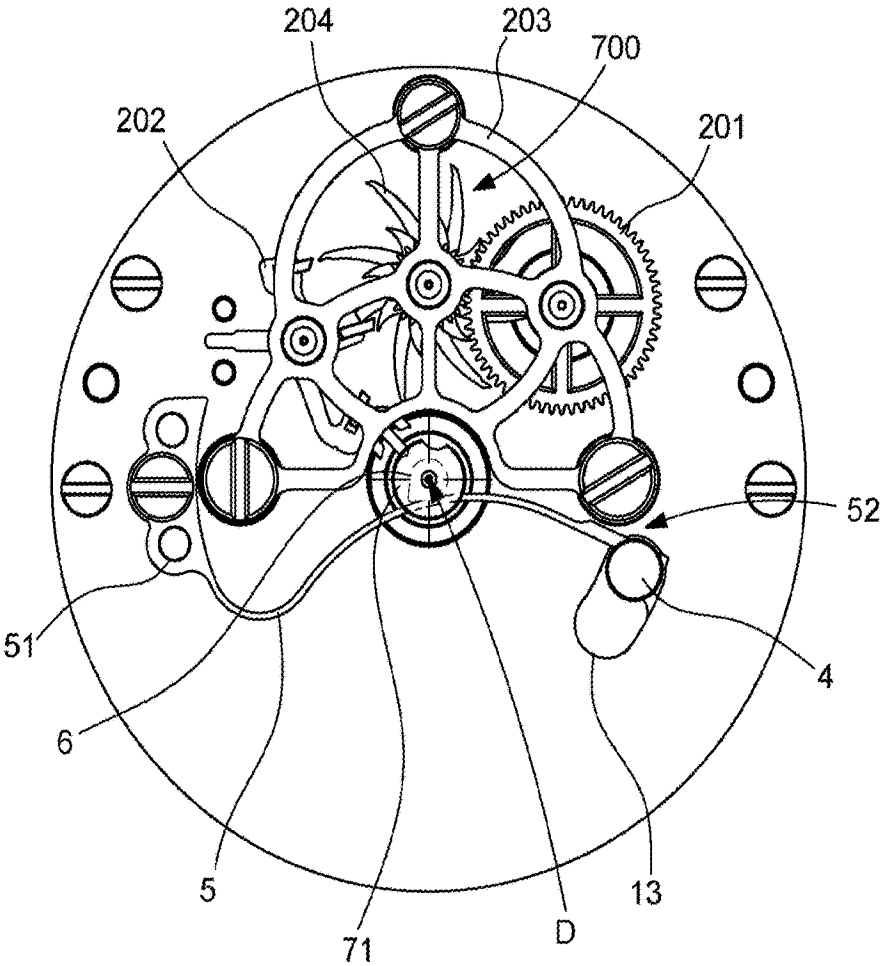
FIGS. 7 and 8 similarly relate to the active position T2 wherein the resilient element engages such that it bears against the stop cam in a blocking manner and wherein the oscillator is stopped.
Figure 7:
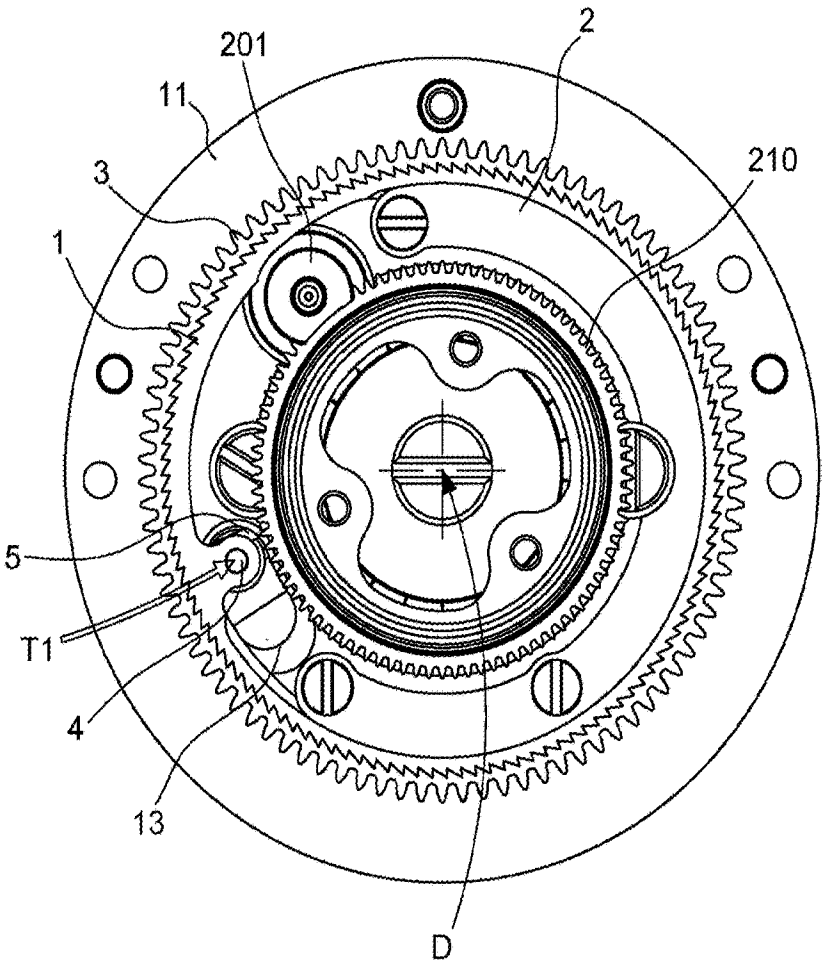

The mechanism shown in the figures comprises a coaxial escapement mechanism 700, which comprises a retainer 202 which is, in this case, a coaxial pallet-lever, a coaxial escape wheel 204, and an inter-escape wheel 201, all pivoted between the lower carriage bridge 11 and an escape bridge 203. FIG. 6, in T1, shows the engagement of the ellipse of the double roller 71 with the fork of the coaxial pallet-lever, FIG. 8, in T2, shows that in the stopped position, the shape of the stop cam 6 imposes a relative position of the double roller 71 and of the retainer 202 that is different from the dead centre.

The external mechanism further creates tension on the carriage 10, which immobilises same, and prevents the torque from reaching the escapement.

It goes without saying that the oscillator 200 is not necessarily centred on the carriage axis D, and can be off-centre. In one specific alternative embodiment, the stop cam 6 is kinematically connected by at least one intermediate wheel of the inertia wheel set of the oscillator 200, and stopping can take place on this intermediate wheel, however this intermediate wheel is not essential. More specifically, since the resilient element 5 can be placed in any location allowing it to engage with the stop cam 6 integral with the balance that is not concentric to the carriage, an appropriate arrangement of the spring forming the resilient element 5 suffices, in another alternative embodiment, for directly affecting the cam integral with a balance that is not concentric to the carriage.

To summarise, the invention allows:

- an inertial mass of an oscillator, in particular a balance, to be instantly stopped;
- a tourbillon or karussel carriage to be instantly stopped;
- the oscillator to be restarted after a hand-setting operation, for which the oscillator has been stopped;
- the time to be set to the nearest second.

The device according to the invention thus comprises a carriage-stop with a stop wheel, which has the advantage of being included in the carriage of the tourbillon or karussel depending on the case, carrying it, which prevents space inside the horological movement from being occupied.

This mechanism with an integrated stop wheel is compact, the manufacture thereof requires conventional technology and the cost thereof is thus low.

The invention claimed is:

1. A horological regulating device for a watch, comprising an oscillator, and comprising means for limiting a variation of rate of said oscillator in different positions of said watch in space, said regulating device comprising at least one tourbillon or a karussel, which comprises a carriage which is mounted such that it pivots about a carriage axis relative to a plate, which carries a fixed wheel when said regulating device comprises a tourbillon, which carriage carries said oscillator and comprises a carriage wheel arranged so as to be driven by an energy source of the watch or of a movement by way of a gear train, and which carriage carries an escapement mechanism arranged so as to engage with said oscillator, and comprising an escape pinion meshing with said fixed wheel when said regulating device comprises a tourbillon or meshing with a wheel of said gear train, when said regulating device comprises a karussel, wherein said regulating device is capable of blocking said oscillator and comprises stopping means with a stop wheel coaxial to said carriage wheel relative to which an angular mobility thereof is limited by a stop pin limited by a slot comprised in said carriage or in a lower bridge comprised in said carriage, said stop wheel comprising a toothing arranged such that it engages with a control member external to said tourbillon or karussel for rotating said stop wheel under the effect of a movement exerted by said control member, and wherein said carriage carries a resilient element, which is arranged so as to bear against a wheel set of said oscillator to stop the latter when said control member is in an active position wherein said stop wheel is in a first angular position relative to said carriage wheel, and which is arranged so as to remain remote from any wheel set of said oscillator when said control member is in a rest position, wherein said stop wheel is in a second angular position relative to said carriage wheel.

2. The regulating device according to claim 1, wherein said wheel set of said oscillator capable of receiving said resilient element bearing thereagainst, is a stop cam synchronous with an inertial mass comprised in said oscillator, and arranged so as to stop the angular indexing of said inertial mass in a position that differs from the dead centre of said oscillator to ease restarting of said oscillator when said stop wheel is released.

3. The regulating device according to claim 2, wherein said stop cam is coaxial with said inertial mass, and is arranged such that said stop cam pivots about said carriage axis.

4. The regulating device according to claim 1, wherein said resilient element is arranged so as to bring said stop wheel back into a rest position relative to said carriage wheel, in the absence of traction on said stop wheel.

5. The regulating device according to claim 1, wherein said stop wheel comprises a pointed and inclined toothing to allow same to engage by hooking with said control member, regardless of the angular position of said stop wheel.

6. The regulating device according to claim 1, wherein said resilient element is or comprises a spring fastened to said carriage or to a lower bridge of said carriage, which lower bridge comprises said slot for limiting the relative angular travel between said stop wheel and said carriage wheel, the ends of said slot forming abutment positions of said stop pin which define said first angular position and said second angular position of said stop wheel relative to said carriage wheel.

7. The regulating device according to claim 1, wherein said oscillator is a sprung balance assembly.

8. The regulating device according to claim 1, wherein said escapement mechanism is a coaxial escapement mechanism, and wherein said escape pinion is an intermediate escape pinion.

9. A watch comprising a horological movement comprising energy storage and/or distribution means, an oscillator, hand-setting means, and a regulating device according to claim 1, comprising said oscillator, wherein said tourbillon or karussel constitutes a display member of said watch, or is arranged so as to drive at least one display member of said watch, and wherein said hand-setting means constitute or control said control member.

10. The watch according to claim 9, wherein said regulating device comprises a tourbillon, and wherein said escape pinion meshes with said fixed wheel comprised in said plate.

11. The watch according to claim 9, wherein said regulating device comprises a karussel, in that said movement comprises a gear train with a third wheel and a fourth wheel, and said escape pinion meshes with a wheel of the gear train or said third wheel or said fourth wheel.

* * * * *